United States Patent [19]

Hoffman

[11] Patent Number: 4,922,800

[45] Date of Patent: May 8, 1990

[54] MAGNETIC SLINGSHOT ACCELERATOR

[75] Inventor: Alan L. Hoffman, Kirkland, Wash.

[73] Assignee: Amoco Corporation, Chicago, Ill.

[21] Appl. No.: 255,708

[22] Filed: Oct. 7, 1988

[51] Int. Cl.[5] ..... F41F 1/02

[52] U.S. Cl. ..... 89/8; 124/3; 310/14; 318/135

[58] Field of Search ..... 89/8; 124/3; 310/14; 318/135

[56] References Cited

U.S. PATENT DOCUMENTS

| | | | |
|---|---|---|---|
| 259,817 | 6/1882 | Cheever | 310/14 |
| 1,384,769 | 7/1921 | MacLaren | 89/8 |
| 1,565,895 | 12/1925 | Blaustein | 124/3 |
| 1,837,550 | 12/1931 | Kaehni et al. | 124/3 |

FOREIGN PATENT DOCUMENTS

| | | | |
|---|---|---|---|
| 809872 | 3/1937 | France | 124/3 |

OTHER PUBLICATIONS

Peaslee, Impact Fusion Workshop, "The Superconducting Slingshot," Aug. 1979, pp. 213–214.

*Primary Examiner*—Stephen C. Bentley
*Attorney, Agent, or Firm*—Seed and Berry

[57] ABSTRACT

A projectile accelerator using reversed magnetic fields to accelerate a cylindrical projectile. The magnetic slingshot (MSA) includes an outer coil which produces a magnetic field within itself and a coaxial inner cylinder with breakable contacts, called a flux reverser. The magnetic field produced by the outer coil is suddenly reversed, trapping the original magnetic field within the flux reverser and storing magnetic energy in the form of magnetic flux lines that curve around the aft end of the projectile, which fits just inside the flux reverser. The stored magnetic field interacts with azimuthal currents, causing an accelerating force along the axis of the coil. A contact in the flux reverser opens aas the projectile passes, allowing the flux lines to closely trail the accelerating projectile and maintaining an imbalance in the accelerating force.

17 Claims, 5 Drawing Sheets

MAGNETIC SLINGSHOT ACCELERATOR

DESCRIPITON

TECHNICAL FIELD

This invention relates to a projectile accelerator, and more particularly, to a projectile accelerator which utilizes the flux lines of reversed magnetic fields.

BACKGROUND ART

In some applications, it is important to be able to accelerate a projectile along a path to relatively high velocities in short periods of time. For example, accelerations to velocities in the range of 2.5 to 4 kilometers per second within a length of a few meters are often desirable. It is further desirable for such projectile accelerators to be efficient.

Accelerators based on the interaction of magnetic fields with the projectile to be accelerated are well-known. Among others, they have taken the forms of rail guns, coaxial accelerators, and coil-shortening accelerators. Rail guns accelerate a conductive projectile through the interaction of a transverse current passing through the projectile from a pair of conductive rails and a magnetic field created by the current. Their proper operation depends upon the development of reliable sliding contacts between the projectile and the two rails.

Coaxial accelerators operate through the generation of a linear series of coaxial magnetic fields. Each magnetic field in the series is generated by the properly-timed initiation of a circumferential current about the projectile. This magnetic field induces a circumferential current in the projectile, and the current and the magnetic field interact to produce the accelerating force which acts on the projectile. A major problem with coaxial accelerators is that the series of magnetic fields must be properly timed and rapidly energized in order to optimize the acceleration of the projectile.

Coil-shortening accelerators operate under the principle that the magnetic fields generated by two similarly wound coils will attract one another. By attaching one such coil to the projectile, the projectile can be accelerated with respect to the other coil. In order to maintain the magnetic field in both coils simultaneously, it is generally necessary that a sliding contact be made between the two coils. As with rail guns, a major problem with coil-shortening accelerators is the development of reliable sliding contacts. In addition, some embodiments of coil-shortening accelerators require an abrupt change in coil resistivity (for example, a piece of superconducting material going from its superconducting state to its normal state).

A more conventional means of accelerating a projectile is based on chemical reactions. While they are well-developed, such chemical accelerators are either inefficient or have ultimate projectile velocities limited to between 1 and 1.5 kilometers per second. This velocity is inadequate for many applications.

It is therefore desirable to have a projectile accelerator which is highly efficient and capable of accelerating projectiles to velocities at least on the order of 2.5 to 4 kilometers per second.

DISCLOSURE OF THE INVENTION

It is an object of the present invention to provide a projectile accelerator using magnetic fields that can accelerate projectiles to velocities at least as high as the range of 2.5 to 4 kilometers per second.

It is another object of the present invention to provide a projectile accelerator which does not require a sliding electrical contact.

It is a further object of the present invention to provide a projectile accelerator which is very efficient.

It is a still further object of the present invention to provide a projectile accelerator which is simple in operation.

It is yet another object of the present invention to provide a projectile accelerator which does not require sophisticated timing circuitry.

Still another object of the present invention is to provide a projectile accelerator which does not require extremely rapid application of magnetic fields.

The invention resides in an apparatus utilizing magnetic fields for accelerating a projectile from a first point to a second point along a path. The apparatus comprises means for producing an axial magnetic field which reverses direction inside the accelerator. The accelerator is essentially a long solenoidal magnet with a full length coaxial inner flux reverser. The flux reverser can carry an azimuthal current capable of reversing the direction of the field produced by the outer solenoidal magnet. A short cylindrical projectile fits just inside the flux reverser, and also carries an azimuthal current. The magnet flux lines flow in one direction inside the flux reverser and projectile, around the back of the projectile, and in the opposite direction on the outside of the projectile and flux reverser. The interaction of the radial component of the magnetic field at the back of the projectile with the projectile current, produces a strong axial force which causes the field lines to act much like "rubber bands" of a slingshot and propel the projectile down the accelerator in the axial direction. As the projectile moves in the accelerator a gap opens in the flux reverser, which interrupts the azimuthal current in the flux reverser, and permits the field lines to "pass through" the flux reverser and follow the projectile.

BEST MODE FOR CARRYING OUT THE INVENTION

Figure 1:
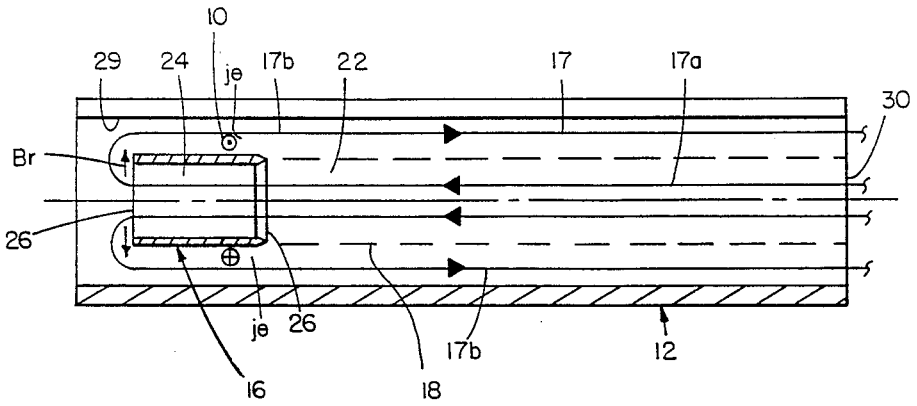
FIG. 1 is a schematic diagram of a projectile accelerator according to the present invention, showing the basic magnetic field configuration.

Referring to FIG. 1, a magnetic slingshot accelerator (MSA) 10 according to the present invention comprises an outer coil 12 which is symmetrically arranged with respect to a longitudinal axis 14. The axis 14 is a path along which the MSA is intended to accelerate a cylindrical projectile 16, as will be more fully described below. The outer coil 12 can be supplied with electrical current from a current supply (not shown) to produce an axial magnetic field. This axial magnetic field is indicated by the magnetic flux lines or field lines 17. A cylindrical flux reverser 18 is symmetrically placed along the axis 14 within the outer coil 12 and is a key element of the invention. The flux reverser 18 is positioned coaxial with and immediately axially adjacent to the projectile 16, and serves the purpose of reversing the direction of the axial magnetic field. The magnetic flux lines 17 include both internal flux lines 17*a*, which are internal to the flux reverser 18 and external flux lines 17*b*, which are external to the flux reverser 18. The projectile 16 is shown in FIG. 1 in an initial stationary position within the MSA 10 prior to being accelerated.

As shown in FIG. 1, the magnetic fields within the MSA 10 are conditioned to accelerate the projectile 16 along the axis 14. This is signified by the fact that the magnetic flux lines 17*a* (which actually constitute a cylinder) pass through an interior 22 of the flux reverser 18 and through an axial central opening 24 of the projectile 16 entering at a circular leading edge 26 of the projectile 16. The magnetic flux lines 17*b* then curve around the circular trailing end 28 of the projectile 16 and between the flux reverser 18 and the outer coil 12 to the "muzzle" 30 of the MSA 10. These magnetic flux lines 17 function analogously to stretched rubber bands which contain potential energy that can be used to launch the projectile 16 when released. The mechanism by which the flux lines 17 can be given this potential energy will be described in greater detail subsequently.

The basic principle of the new acceleration invention can be explained by reference to FIG. 1. An antiparallel magnetic field configuration is created inside the cylindrical outer coil 12, with a thin metal cylindrical ring serving as the projectile 16 residing at the end of the MSA 10 away from the terminal free end 30. The net flux inside the outer coil 12 is low, but the magnetic fields and magnetic energy are high, providing a source of energy for acceleration. The antiparallel field configuration can be induced and maintained by the flux reverser 18. The projectile 16 itself could act as the flux reverser 18 over the full length of the coil 12, but it would then be too heavy to be accelerated to high velocities.

The key technology required is the flux reverser 18, which need not be accelerated with the projectile 16. It would be possible to accelerate the flux reverser 18 with the projectile 16 if a light weight flux reverser, such as a plasma utilized in field-reversed-configuration (FRC) confinement schemes, were used. The flux reverser 18 must maintain the antiparallel field configuration during the acceleration of the projectile 16 (typically for milliseconds), and allow magnetic field penetration after the projectile 16 starts moving. Axial drive forces are produced by the interaction of circumferential $j_\theta$ currents in the projectile 16 and radial $B_r$ magnetic fields near the rear edge 28 of the projectile 16. Reducing the $B_r$ magnetic field at the leading edge 26 of the projectile 16 results in a high unidirectional force along the axis 14.

Figure 2A:
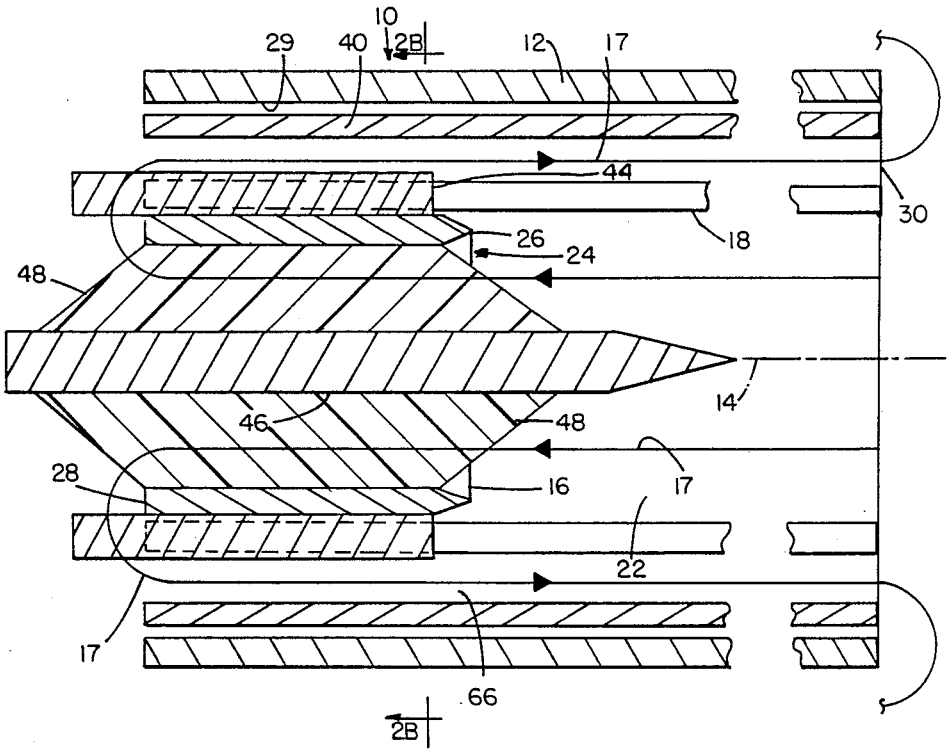
FIG. 2A is a schematic, fragmentary, axial cross sectional view of a projectile accelerator according to the present invention illustrated in FIG. 1.

FIG. 2A is an axial cross sectional view of a preferred embodiment of the MSA 10. A flux shell 40 can be positioned coaxially within and immediately adjacent to the interior surface 29 of the outer coil 12, permitting multiturn outer coils to be used. The projectile 16 can be made from an electrically conductive material, such as aluminum. The projectile 16 includes one or more breaker tabs 44, which extend radially outward from the projectile 16 and serve a purpose to be explained subsequently. If desired, a payload 46 can be attached to the projectile 16. The payload 46 can be supported from the projectile 16 along the axis 14 by means of a plurality of wing supports 48. If desired, the wing supports 48 can be made from a plastic material that shears away from the payload 46 when the wing supports 48 are subjected to outwardly-directed radial forces.

Figure 2B:
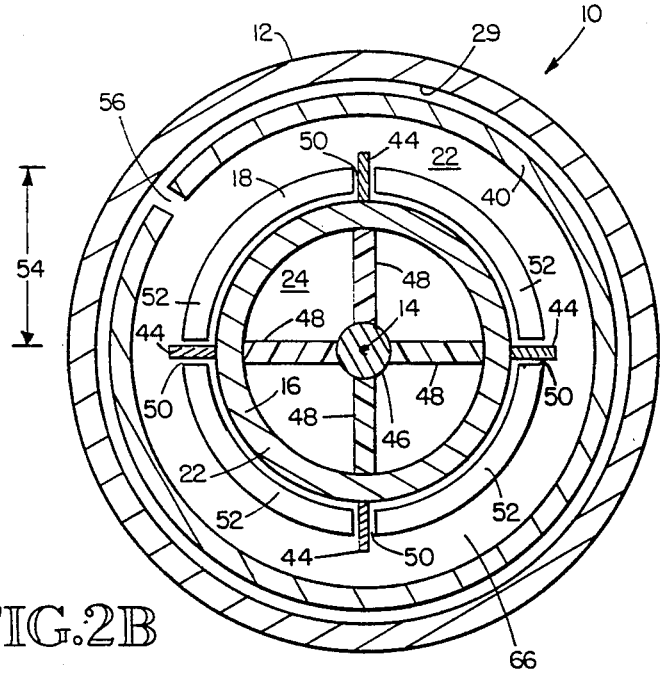
FIG. 2B is a transverse cross sectional view of the projectile accelerator taken substantially along the line 2B—2B of FIG. 2A.

An axial view of the MSA 10 and projectile 16 is given by FIG. 2B. The flux reverser 18 includes four longitudinal gaps 50 which receive the breaker tabs 44 attached to the projectile 16. Before the projectile 16 starts moving, these gaps 50 are bridged by electrical contacts and carry the $j\theta$ current necessary to reverse the axial field. The contacts are broken by passage of the projectile 16 and allow the magnetic flux lines 17 to follow the projectile 16, giving it a continuous axial force.

As shown in FIGS. 2A and 2B, the stationary flux reverser 18 is a single turn coil (most likely copper), which is segmented by the longitudinal gaps 50 into several longitudinally extending azimuthal sections 52, four quarter-circular sections being shown in FIG. 2B, such that the azimuthal current flow can be interrupted. The most critical aspect of the flux reverser 18 is that a continuous electrical contact exists in the longitudinal gaps 50 between the azimuthal sections 52, which can be sequentially broken by the passage of the projectile 16. The projectile 16 can be accelerated at lower efficiency without the gaps 50 if the resistance of the flux reverser is carefully chosen.

As the projectile 16 is driven down the MSA 10, its travel can be used to break the contact in the longitudinal gaps 50 through various mechanisms which are discussed subsequently. This gap breaking is made easier by the fact that the net flux inside the flux reverser 18 will not change initially as the projectile 16 is driven into it, and the total circumferential line current (sum of the kiloAmperes/cm in the projectile 16 and the flux reverser 18) at the axial position of the projectile 16 will become equal to the line current originally in the projectile. The total line current will remain in either the flux reverser 18 or the projectile 16, but cannot be present in both.

The breaker tabs 44 of the projectile 16 are positioned in the longitudinal gaps 50 to preferentially maintain the current in the projectile 16. The projectile 16 and the flux reverser 18 are made close fitting so that the flux between the two, which must be reversed if the current through the flux reverser 18 is to be halted, is small. The initial voltage appearing across the longitudinal gaps 50 can then be very low.

After the projectile 16 passes a given section of the flux reverser 18 as it moves toward the terminal free end 30 of the MSA 10, the original flux inside the flux reverser is convected along with the projectile 16, since the inside magnetic flux lines 17*a* are connected with the outside magnetic flux lines 17*b*, and the flux lines 17 act much as rubber bands. The flux lines 17 pass through the flux reverser 18 within a distance equal to about one flux reverser radius 54 of the rear of the projectile. The gap standoff voltage between adjacent azimuthal sections 52 will be increased over that distance, but there need be no resistive dissipation of the magnetic field energy since the full magnetic field energy is ideally converted into projectile kinetic energy.

It may be found desirable to extend the breaker tabs 44 rearward for a distance equal to about one flux reverser radius 54, and to segment the flux reverser axially. The axial segmentation will provide more area for flux lines 17*a* to escape through, and will prevent eddy currents in the flux reverser 18 from severely inhibiting flux convection, or from causing excessive forces on the MSA 10 or components of the projectile 16. Axial segmentation may also be useful for some contactor designs.

It is not necessary that the fluxes or magnetic fields inside and outside the flux reverser 18 be equal. If the net flux is zero, however, all the magnetic flux lines 17 will follow the projectile 16 and the initial magnetic energy will be converted into projectile kinetic energy with an ideal efficiency of 100%. It will also be optimal for the magnetic field magnitudes inside and outside to be equal, since this condition will maximize the energy storage for a given magnetic field limit, and will also minimize the hoop stresses in the projectile 16 and flux reverser 18. The line current densities in the projectile 16 and the flux reverser 18 will then be oppositely directed to, and double the line current density of the outer coil 12.

As previously noted, the flux shell 40 allows a multi-turn outer coil (solenoid) to be used as the outer coil 12 and still distribute the net line current of the outer coil 12 to produce the desired axial magnetic field distribution, which is approximately a step function following the projectile, during projectile acceleration. The flux shell 40 is slit longitudinally along a longitudinally extending gap 56, and carries no net azimuthal current. It carries eddy currents only during the projectile acceleration, and can be made quite thin. Alternatively, the multi-turn outer coil 12 could be divided into multiple parallel sections, making the flux shell 40 unnecessary. This technique has been used successfully to produce the equivalent of a multi-turn flux reverser 18 for FRC formation. It is the preferred technique from space and eddy loss considerations.

The projectile 16 will most likely be aluminum in order to provide the highest possible conductivity to weight ratio. Practical limits on the attainable projectile velocity will be set by the mass of the projectile 16 that is required to prevent excessive internal flux loss (high L/R time) and projectile ring melting. Preliminary analysis shows that kilogram-size projectiles can be accelerated to about 5 km/sec if they are made from aluminum. The maximum achievable velocity is governed by melting of the projectile ring, and scales approximately as the one-third power of the total ring/payload mass. Higher velocities for smaller mass projectiles might be achievable with cryogenic or with superconducting rings, if suitable high field superconductors are developed.

A preliminary analysis has included considerations of heating of the ring of the projectile 16 and transfer of forces from the aluminum ring to the payload 46. About half of the total weight was allocated to the payload 46, and half to the ring 16 and wing supports 48. The ring ideally would not be of uniform thickness since it is desirable for some of the flux lines to penetrate the ring to promote a more uniform "body force" drive.

A simple circuit scheme to create the antiparallel field configuration discussed above is shown in FIG. 3. A battery 60 or low voltage power supply supplies current to the outer coil 12 on a time scale long enough to allow the flux lines 17 to penetrate through the aluminum ring of the projectile 16 and the flux reverser 18. This time scale is only set by heating considerations in the outer coil 12. The flux shell 40 (shown in FIG. 2A) does not carry currents during this time period, and can actually be relatively thin.

Figure 4:
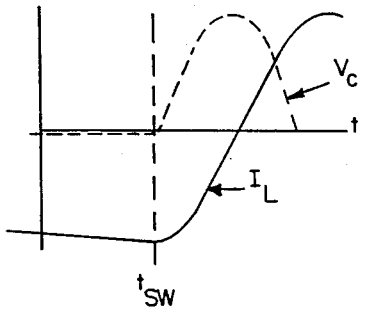
FIG. 4 is a graph depicting time histories of voltage and current in the circuit shown in the schematic diagram of FIG. 3.

When the current in the outer coil 12 has reached its full value, a switch 62 is opened and the current in the outer coil 12 will begin to flow in the leg of the circuit containing a capacitor 64. The total current decreases and is reversed as the capacitor 64 first charges and then discharges as shown in the time history of FIG. 4. The current reversal in the outer coil 12 reverses the direction of the magnetic field in the region 66 between the outer coil and the ring/flux reverser 18 combination, shown in FIGS. 2A and 2B).

The reversal must occur on a time scale considerably less than the L/R time of the ring of the projectile 16 and the flux reverser 18 in order to preserve the now oppositely directed flux inside the projectile 16 and the flux reverser 18. This typically may require single turn voltages of about 100 volts, or multi-turn voltages of several kilovolts. Only the flux in the region 66 between the outer coil 12 and the projectile 16 and flux reverser 18 must be reversed, so that the capacitor 64 must be able to absorb, instantaneously, about half the energy in the system.

Other drive schemes are possible to create the reverse field configuration, but the above-described one is the most efficient known. For large systems, rotating machinery can be used for the capacitive transfer element as well as the basic power supply.

The magnetic slingshot accelerator MSA 10 is somewhat similar in conception to various coaxial acceleration schemes involving a form of "coil shortening". Those schemes, however, either require sliding contacts or an abrupt change in coil resistivity, such as a superconductor going normal. Previously proposed coil shortening schemes also do not utilize the flux reverser-/anti-parallel field configuration which increases both the magnetic energy storage and the ratio of axial to radial forces.

The MSA 10 has considerable advantages over a conventional rail gun. The outer coil 12 serves as both an accelerator and an energy storage mechanism. The inductive energy is released by the action of the projectile 16 itself. No fast external switching is necessary. The axial magnetic forces on the projectile 16 are high, but radial "bursting" forces can be fairly low on all other elements of the MSA 10. No current need flow between rails and projectile.

If the inner and outer magnetic fields imposed by the MSA 10 on the projectile 16 are equal, there is no hoop stress in the aluminum ring of the projectile 16 or the flux reverser 18 during acceleration. After the projectile 16 emerges from the accelerator it can be kept intact, if desired, by making it strong enough to resist the hoop stress produced by the now unbalanced internal magnetic field pressure, or it can be allowed to explode outward, acting only as a sabot for the payload 46 during acceleration.

Figure 3:
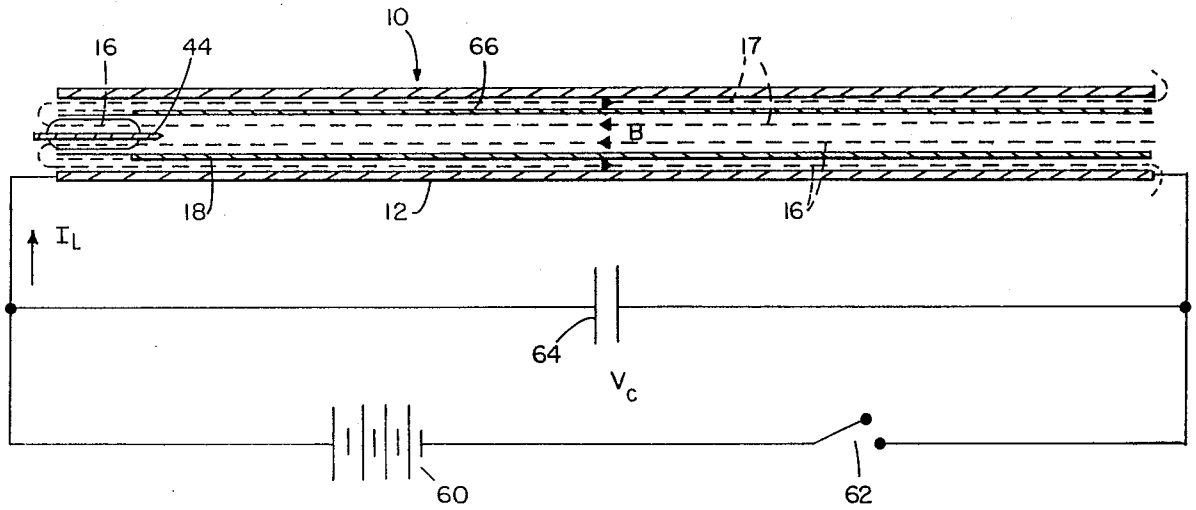
FIG. 3 is a schematic diagram of an electrical circuit for use with the projectile accelerator shown in FIG. 2A.

For the drive scheme shown in FIG. 3, only a single switch 62 is necessary, which can be opened at very low voltage, and is naturally commutated by the presence of the large transfer capacitor 64. A small initial charge on the transfer capacitor 64 will drive the switch current to zero, making commutation especially simple. The physical size of the capacitor 64 can be kept relatively modest since it is only charged unidirectionally for a short time.

The ideal drive efficiency of the scheme is 100%, with practical efficiencies determined by second order effects such as element resistivities and stray inductances.

The breakable longitudinal gaps 50 (see FIG. 2B) could be either movable mechanical contacts, flexible brushes, replaceable wire or liquid metal arrays, or even very narrow gaps which carry the line current through a plasma arc which is formed when the current is induced in the flux reverser 18. Each mechanism may have advantages for a particular projectile velocity range.

Figure 5A:
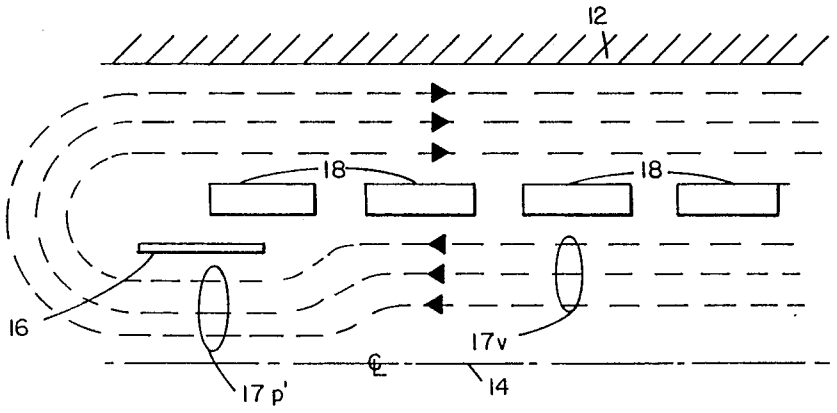
FIG. 5A is a schematic axial cross sectional view of a portion of the projectile accelerator according to the present invention, showing a first condition of the magnetic flux in the projectile accelerator.

A novel arrangement of the invention shown in FIG. 5A makes use of the changing magnetic forces and transformer action induced by the motion of the projectile 16. If the magnetic flux 17*p* in the projectile 16 is the same as the flux 17*r* inside the flux reverser 18, the projectile 16 will have very little effect on the magnetic field geometry as it enters the sections of the flux reverser 18. It is clear for this case that the current in the flux reverser 18 is reduced (the magnetic field jump across it is decreased), but not eliminated.

Figure 5B:
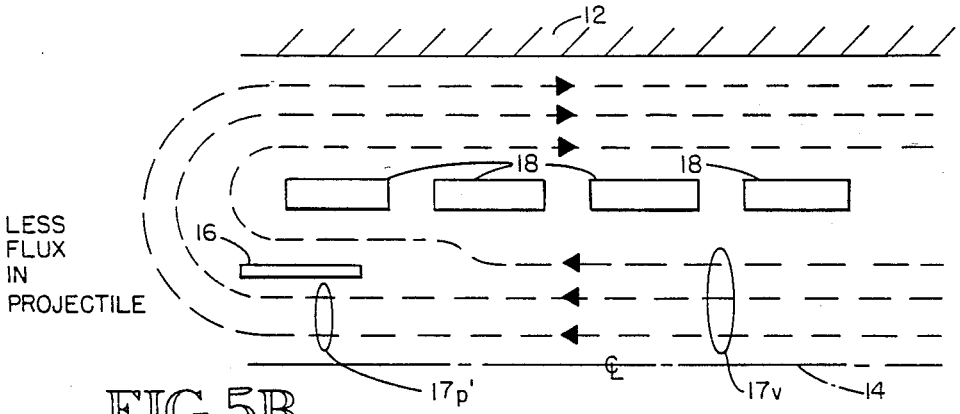
FIG. 5B is a schematic axial cross sectional view of a portion of the projectile accelerator of FIG. 5A, showing a second condition of the magnetic flux in the projectile accelerator.

If the flux 17*p*, inside the ring of the projectile 16 is less than the flux 17*r* inside the flux reverser, it will increase the field between itself and the flux reverser as illustrated in FIG. 5B. This increases the current in the flux reverser 18 and is an undesirable occurrence from the point of view of interrupting this current.

Figure 5C:
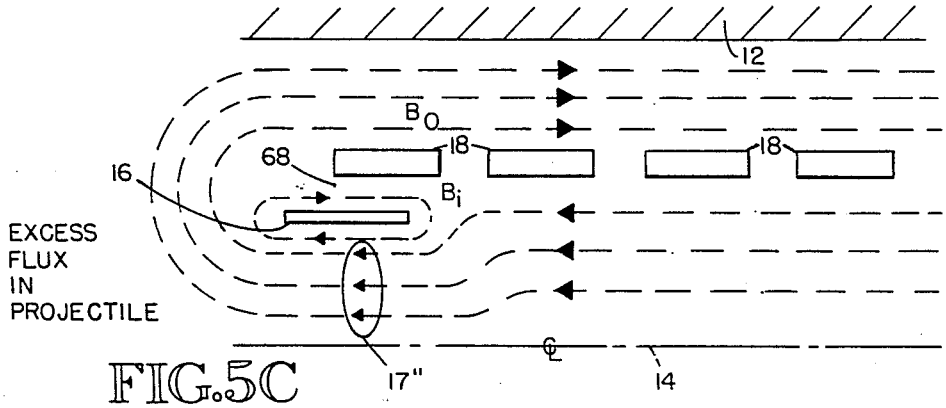
FIG. 5C is a schematic axial cross sectional view of a portion of the projectile accelerator of FIG. 5A, showing a third condition of the magnetic flux in the projectile accelerator.

The ideal situation (termed a "negative area projectile") is indicated in FIG. 5*c*, where the flux 17*p*″ in the projectile 16 exceeds the flux reverser flux 17*r*, and the direction of the magnetic field $B_1$, in the gap 68 between the ring of the projectile and the flux reverser, is reversed. Depending on the relative magnitudes of fluxes 17*p*″ and 17*r*, and the gap 68 between the flux reverser 18 and the projectile 16, the current in the flux reverser will be driven to zero.

Figure 6:
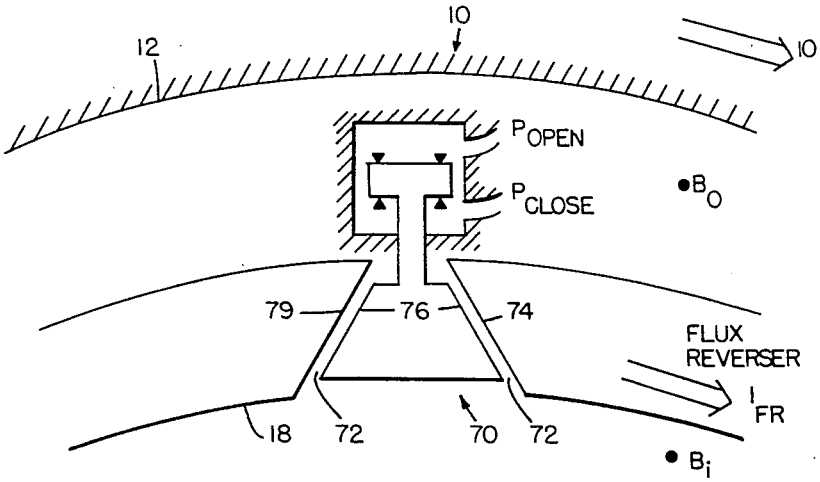
FIG. 6 is a schematic axial cross sectional view of a portion of the flux reverser of the projectile accelerator of FIG. 2A.
Figure 7:
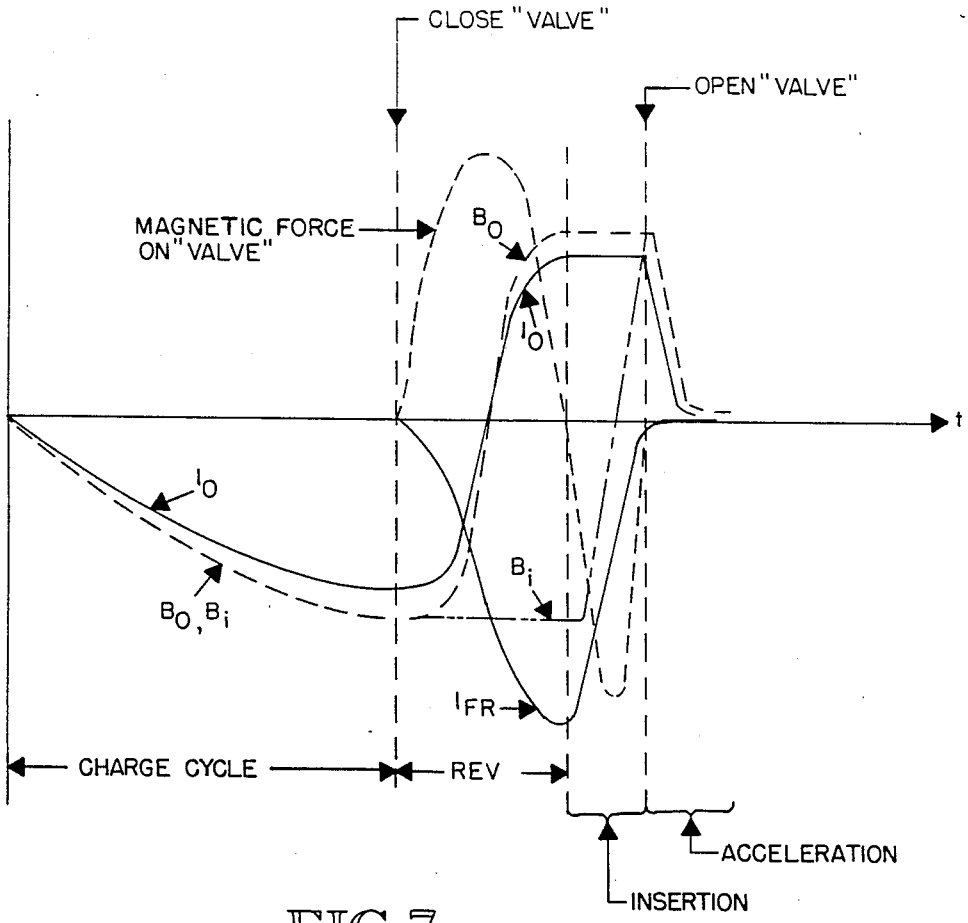
FIG. 7 is a graph depicting time histories of valve currents, magnetic fields, and magnetic forces in the projectile accelerator of FIG. 2A corresponding to the magnetic conditions shown in FIG. 5C.

A mechanical contact to take advantage of the "negative area" projectile of FIG. 5*c* is shown in FIG. 6. Time histories of the net line current $I_0$ through the outer coil 12 and flux shell 40 and the flux reverser current $I_{fr}$ are shown in FIG. 7. The resultant inside, $B_i$, and outside, $B_o$, magnetic fields, as defined in FIG. 5C, are also sketched, along with the net resultant force on a contactor 70, which is called a magnetic "valve".

The contactor 70 can be positioned pneumatically, but the main seating or unseating forces are due to the differences in magnetic pressure inside and outside the flux reverser (JXB force on the valve). Initially the Contactor 70 is open as the outer coil 12 is charged, allowing flux to freely penetrate the flux reverser 18. This is done slowly, so that a valve gap 72 may only experience a few volts. Once the current $I_o$ in the outer coil 12 reaches its maximum value, the contactor 70 is closed pneumatically, and the current reversal process described previously is started. The flux reverser 18 now carries current and experiences a large net outward force due to the reduced value of the outside magnetic field $B_o$. This force fully seats the contactor 70 and results in a low resistance contact during the current reversal process in the outer coil 12.

Once the flux reversal is complete, the MSA 10 is fully charged and ready for the passage of the projectile 16. For the situation shown in FIG. 5*c*, the insertion of the projectile 16 will reverse the force on the contactor 70 and drive it inward. Opening of the contactor 70 can be pneumatically assisted if desired, but the bulk of the opening force will be magnetic, and thus naturally sequenced. Some analysis and trial and error will have to be done to arrive at the optimum timing. The valve contacts 74 and 76 will arc slightly, but there is no energy behind this arc, and the flux reverser current $I_{fr}$ is actively driven to zero by the transformer action of the projectile.

Ideally, there will be very little voltage across the contactor 70 during the passage of the projectile 16. However, the flux must follow the projectile after its passage, and a voltage of several kilovolts per valve gap 72 can be induced across the contactor 70. It is for this reason that the projectile 16 should contain some sort of insulating tab 44 which will slide into the valve gaps 72 and extend rearward about one flux reverser radius distance 54 as mentioned in the preceding section and shown in FIG. 3.

The contactor 70 need open only about 1 millimeter to make this practical. This is simple to accomplish even at the highest projectile velocities due to the strong magnetic forces. For example, at a 30 T magnetic field, an average acceleration of $10^7$ m/s$^2$ can be produced on a 10 g valve with 2 cm$^2$ area. At a velocity of 4 km/sec a 10 cm long projectile will pass the valve in 25 μsec, during which time the valve must fully open. With the accelerations of the order mentioned above, 5 mm opening distances are possible. At lower velocities and magnetic fields, the opening distance remains about the same, but the accelerations are lower and the construction of the contactor 70 will be simpler.

While the detailed description above has been expressed in terms of specific examples, those skilled in the art will appreciate that many other apparatus could be used to accomplish the purpose of the disclosed inventive apparatus. Accordingly, it can be appreciated that various modifications of the above-described embodiments may be made without departing from the spirit and the scope of the invention. Therefore, the present invention is to be limited only by the following claims.

I claim:

1. Apparatus for accelerating a projectile from a first point at which the projectile is initially positioned to a second point along a path, the projectile being electrically conductive and having an aperture therethrough defining leading and trailing regions of the projectile, the path passing through the aperture, the leading region being disposed in the direction from the first point to the second point and the trailing region being disposed in the direction from the second point to the first point, the apparatus comprising:

first means for producing a magnetic field having first and second sequential antiparallel orientations, both sequential orientations of said magnetic field having magnetic flux lines that are substantially parallel to the path, said magnetic field producing azimuthal currents in the projectile, said azimuthal currents circulating in planes that are substantially transverse to the path; and a magnetic flux reverser for producing unbalanced magnetic fields around the projectile, said unbalanced magnetic fields interacting with said azimuthal currents in the projectile to produce accelerating forces on the projectile, including:

second means for maintaining and controllably containing at least some of said magnetic flux lines of said first orientation of said first magnetic field along the path, said at least some magnetic flux lines passing through the aperture defined in the projectile, and further for maintaining said second orientation of said magnetic field radially outward of the projectile, said antiparallel magnetic flux lines of said first and second magnetic field orientations being connected by magnetic flux lines curving at a curvature point behind the trailing region of the projectile; and third means associated with said second means for moving said curvature point along with the projectile as the projectile accelerates.

2. The apparatus of claim wherein said first means is fixedly extended along the path.

3. The apparatus of claim 1 wherein said second means is fixedly extended along the path.

4. The apparatus of claim 3 wherein the projectile maintains a close-fitting relationship with the second means as the projectile is accelerated along the path.

5. The apparatus of claim wherein said second means is cylindrical and fixedly extended along the path and the projectile maintains a close-fitting relationship with the second means as the projectile is accelerated along the path.

6. The apparatus of claim 5 wherein said first means is fixedly extended along the path and radially disposed outwardly of said second means.

7. The apparatus of claim 1 wherein said third means comprises an elongated magnetic valve being disposed along a longitudinal axis in the second means, said magnetic valve being fully closed along the axis before the projectile begins to accelerate and sequentially opening along the axis as the trailing region of the projectile passes, thereby allowing the curvature point to closely follow behind the trailing region of the projectile.

8. The apparatus of claim 1 wherein the first means is a cylindrical coil, symmetrically disposed about the path, for carrying substantially azimuthal currents and producing said magnetic field having said first and second orientations, depending upon the direction of the currents through the coil.

9. The apparatus of claim 8 wherein said second means has a cylindrical shape with longitudinal gaps and is disposed within said first means.

10. The apparatus of claim 9 wherein the projectile has a cylindrical shape that fits closely within the second means and includes radially projecting tabs that extend through said longitudinal slots, said tabs preventing transverse electrical connections across slots, thereby preventing azimuthal currents to flow in said second means.

11. A magnetic slingshot accelerator, comprising:

an electrically conductive projectile disposed along a path having a first point and a second point, said projectile being initially positioned at said first point, the projectile having an aperture therethrough, said aperture defining leading and trailing regions of the projectile, the path passing through the aperture, the leading region being disposed in the direction from the first point to the second point and the trailing region being disposed in the direction from the second point to the first point;

first means, comprising a cylindrical coil symmetrically disposed about said path, for carrying first substantially azimuthal currents and producing a magnetic field having sequential first and second antiparallel orientations, depending upon the direction of the currents through the coil, both sequential orientations of said magnetic field having magnetic flux lines that are substantially parallel to the path, said magnetic field producing second azimuthal currents in said projectile, said azimuthal currents circulating in planes that are substantially transverse to said path;

a magnetic flux reverser for producing unbalanced magnetic fields around the projectile, said unbalanced magnetic fields interacting with said azimuthal currents in the projectile to produce accelerating forces on the projectile, including:

second means for maintaining and controllably containing at least some of said magnetic flux lines of said first orientation of said first magnetic field along the path, said at least some magnetic flux lines passing through the aperture defined in the projectile, and further for maintaining said second orientation of said magnetic field radially outward of the projectile, said antiparallel magnetic flux lines of said first and second magnetic field orientations being connected by magnetic flux lines curving at a curvature point behind the trailing region of the projectile, and third means associated with said second means for moving said curvature point along with the projectile as the projectile accelerates; and a switchable power supply, connected to said first means, for generating said first azimuthal currents.

12. The magnetic slingshot accelerator of claim 11 wherein said second means has a cylindrical shape with longitudinal gaps and is disposed within said first means.

13. The magnetic slingshot accelerator of claim 12 wherein the projectile comprises a cylindrical shape that fits closely within the second means and includes radially projecting tabs that extend through said longitudinal slots, said tabs making transverse electrical connections across slots, thereby allowing azimuthal currents to flow in said second means.

14. The magnetic slingshot accelerator of claim 13, said projectile further comprising a payload supported along said path within said cylindrical shape by supports.

15. The magnetic slingshot accelerator of claim 14 wherein said cylindrical shape is made from aluminum.

16. The magnetic slingshot accelerator of claim 11 wherein said switchable power supply comprises a capacitor connected in parallel with a series combination of a switch and a DC voltage source, the switch having a closed position and an open position, said first orientation of said magnetic field being generated when said switch is in said closed position and said second orientation of said magnetic field being generated when said switch is in said open position.

17. The apparatus of claim 11 wherein said third means comprises an elongated magnetic valve being disposed along a longitudinal axis in the second means, said magnetic valve being fully closed along the axis before the projectile begins to accelerate and sequentially opening along the axis as the trailing region of the projectile passes, thereby allowing the curvature point to closely follow behind the trailing region of the projectile.

* * * * *

UNITED STATES PATENT AND TRADEMARK OFFICE

CERTIFICATE OF CORRECTION

PATENT NO. : 4,922,800

DATED : May 8, 1990

INVENTOR(S) : Alan L. Hoffman

It is certified that error appears in the above-identified patent and that said Letters Patent is hereby corrected as shown below:

In claim 2, column 9, line 29, following "claim" insert --1--.

In claim 5, column 9, line 36, following "claim" insert --1--.

Signed and Sealed this

Eighth Day of October, 1991

*Attest:*

HARRY F. MANBECK, JR.

*Attesting Officer*

*Commissioner of Patents and Trademarks*